US005095962A

United States Patent [19]

Lloyd-Davies et al.

[11] Patent Number: 5,095,962

[45] Date of Patent: Mar. 17, 1992

[54] BEVERAGE DISPENSER COUPLING

[75] Inventors: William T. Lloyd-Davies; Chester Savage, both of Irvine, Calif.

[73] Assignee: Scholle Corporation, Irvine, Calif.

[21] Appl. No.: 565,250

[22] Filed: Aug. 9, 1990

[51] Int. Cl.[5] ..... B65B 3/04

[52] U.S. Cl. ..... 141/346; 222/400.7; 222/105; 141/349; 141/351; 141/114; 141/354

[58] Field of Search ..... 222/400.7, 105; 141/346, 348, 349, 350, 351, 352, 353, 354, 355, 357, 114

[56] References Cited

U.S. PATENT DOCUMENTS

| | | | |
|---|---|---|---|
| Re. 32,354 | 2/1987 | Savage | 222/81 |
| 1,311,745 | 7/1919 | Beurmann . | |
| 2,784,987 | 3/1957 | Corcoran | 285/87 |
| 2,789,839 | 4/1957 | Siebert | 285/7 |
| 2,789,841 | 4/1957 | Kramer | 285/177 |
| 3,184,091 | 5/1965 | Hoffman | 217/99 |
| 3,223,117 | 12/1965 | Curie et al. | 137/556.6 |
| 3,307,598 | 3/1967 | Lowenthal | 141/311 |
| 3,746,376 | 7/1973 | Gold | 285/334.2 |
| 3,945,603 | 3/1976 | Fraser | 251/148 |
| 4,137,930 | 2/1979 | Scholle | 137/68 R |
| 4,286,636 | 9/1981 | Credle | 141/114 |
| 4,351,455 | 9/1982 | Bond | 222/153 |
| 4,353,488 | 10/1982 | Schneiter et al. | 222/501 |
| 4,375,864 | 3/1983 | Savage | 222/81 |
| 4,380,310 | 4/1983 | Schneiter et al. | 222/501 |
| 4,421,146 | 12/1983 | Bond et al. | 141/349 |
| 4,441,745 | 4/1984 | Nicholas | 285/417 |
| 4,445,551 | 5/1984 | Bond et al. | 141/349 |
| 4,451,069 | 5/1984 | Melone | 285/86 |
| 4,874,023 | 10/1989 | Ulm | 141/346 |
| 4,991,635 | 2/1991 | Ulm | 141/346 |

*Primary Examiner*—Ernest G. Cusick

*Attorney, Agent, or Firm*—Richard F. Carr; Richard L. Gausewitz; Allan Rothenberg

[57] ABSTRACT

The fluid dispensing device includes a tubular spout attachable to a fluid-containing vessel, such as a bag, the spout including an outer end portion of a first lateral dimension and an inner portion of a smaller lateral dimension. A valve member is slidable in the spout, the valve member being tubular and having an open outer end adapted to receive a fluid-transmitting probe and a closed inner end. The valve member has openings through its sidewall. The outer end portion of the valve member is laterally outwardly deflectable and includes localized protrusions adapted to enter the recess of a probe. In the closed position of the valve member, opposed shoulders of the valve member and of the spout resist axial movement of the valve member in either direction, and interengaged sealing surfaces block fluid flow to the openings. The outwardly deflectable portion of the valve member can be deflected as the probe enters, and the protrusions thereafter spring inwardly into the recess of the probe. The valve member then is movable by the probe to an inner open position in which the openings are uncovered, and the protrusions in the probe recess allow the valve member to be moved back to the closed position.

13 Claims, 3 Drawing Sheets

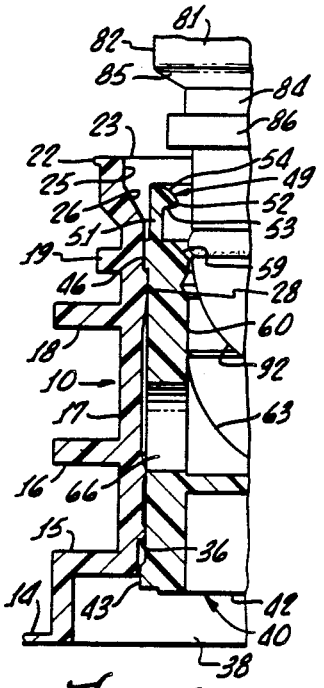
FIG. 8.
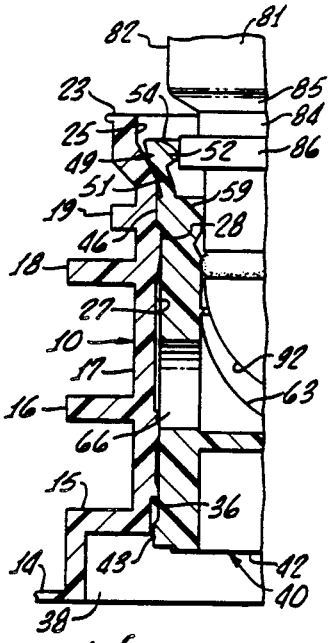
FIG. 9.
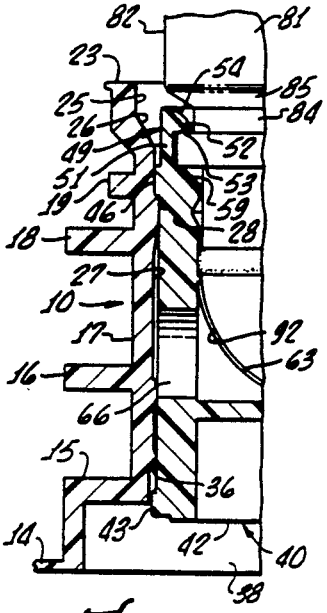
FIG. 10.
FIG. 11.
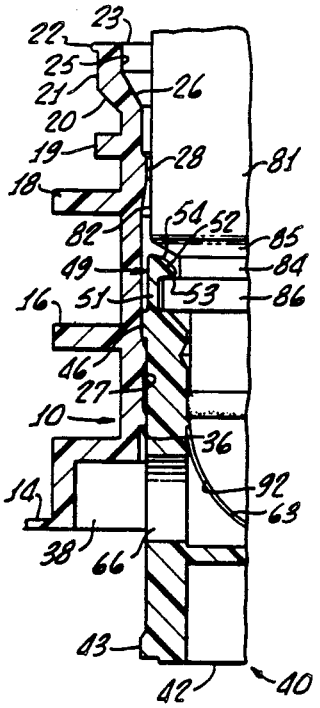
FIG. 12.
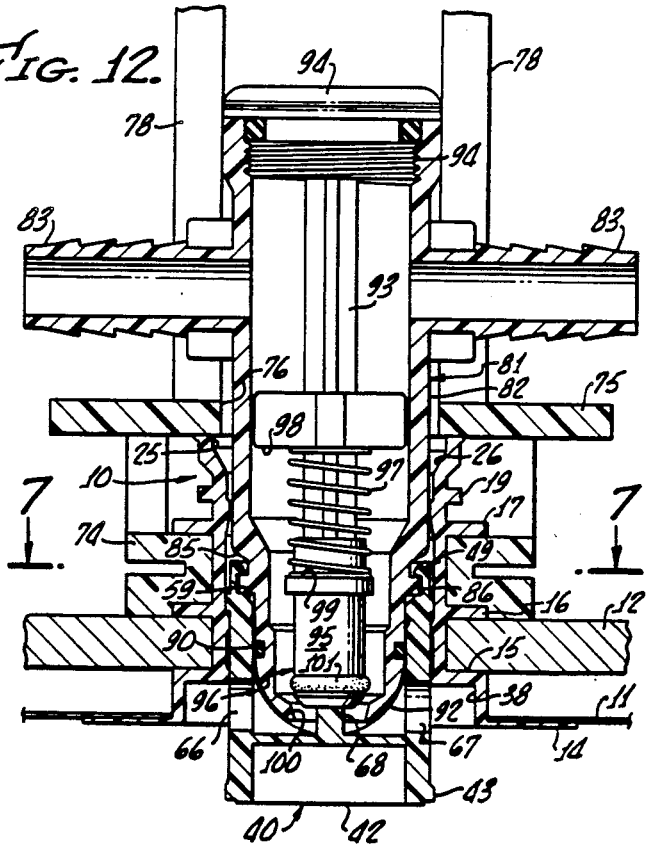

BEVERAGE DISPENSER COUPLING

BACKGROUND OF THE INVENTION

Liquids, such as syrups used in soft drinks, frequently are packaged in bags contained in boxes of corrugated paper from which they must be dispensed for fountain and bar use. Consequently, an arrangement must be provided to rapidly connect a probe to the box through which the liquid is to be dispensed, as controlled by a suitable valve member. A device of this type is shown in U.S. Pat. No. 4,445,551, which includes a spout attached to the bag and a valve member movable within the spout. Opening of the valve is accomplished by inserting the liquid-dispensing probe into the valve and pushing it inwardly to uncover openings through which the liquid can flow. In order to permit the valve to be closed, the design of this patent includes a plurality of small lugs, each on a thin resilient arm, which has an outwardly extended free position. These arms and the lugs must be deflected inwardly so as to enter a groove in the probe. These lugs are held in their deflected inward position by the wall of the spout as the valve member is moved axially into the spout. Hence, reverse axial movement of the probe can move the valve outwardly to close it. The arms then spring outwardly of their own accord to release the probe.

However, these individual lugs on the thin arms are relatively delicate and have some vulnerability to damage, when exposed. Moreover, in this design there is no positive stop to retain the valve in its closed position prior to entry of the probe into the valve. Only friction holds it in this position. Hence, the valve can be moved inadvertently to the opened position before the probe is inserted. In general, the ruggedness and reliability of prior art liquid dispensers need improvement, and excessive expense and complexity have been a problem.

SUMMARY OF THE INVENTION

The present invention provides an improved liquid dispensing arrangement of relatively simple design, rugged construction, and improved reliability. The components of the device are strong and hot subject to inadvertent damage, and a positive stop arrangement is provided to hold the valve in the closed position. Hence, the valve will remain closed until the probe enters it.

These results are accomplished by providing a valve member having a portion that is deflected outwardly by the probe as the probe enters, returning to its normal inward position as it enters a groove in the probe. In one version, there are localized inward protrusions spaced around the circumference of the outer end wall of the valve member. When the probe enters the valve member, it deflects the protrusions outwardly, permitting them to snap back inwardly to their normal position as the annular groove in the probe is reached. This connects the valve member to the probe. Thereafter, the outer end of the valve member maintains its normal position as the valve is moved inwardly to the opened position, no further deflection of the retention elements being necessary. Because of the protrusions within the annular groove of the probe, the probe can pull the valve outwardly to a closed position.

In addition, as an important advantage, the dispenser of this invention includes shoulders on the spout and on the valve member which hold the valve against substantial axial movement when it is in the closed position.

The result is a positive stop which retains the valve in place until moved by the probe and avoids inadvertent shifting of the valve to the open position.

BRIEF DESCRIPTION OF THE DRAWINGS

FIG. 8 is a fragmentary longitudinal sectional view showing the assembled valve and spout with the valve held against axial movement and the probe entering;

FIG. 9 is a view similar to FIG. 8 showing an intermediate position with the valve member deflected outwardly at one end;

FIG. 10 is a view similar to FIGS. 8 and 9 showing the probe further advanced with the valve member returned to its normal position and the protrusions of the valve member received in the recess in the probe;

FIG. 11 is a view similar to FIGS. 8–10 showing the valve member moved to an open position by the probe; and FIG. 12 is a longitudinal sectional view of the valve moved by the connector to the open position.

DETAILED DESCRIPTION OF THE INVENTION

Figure 1:
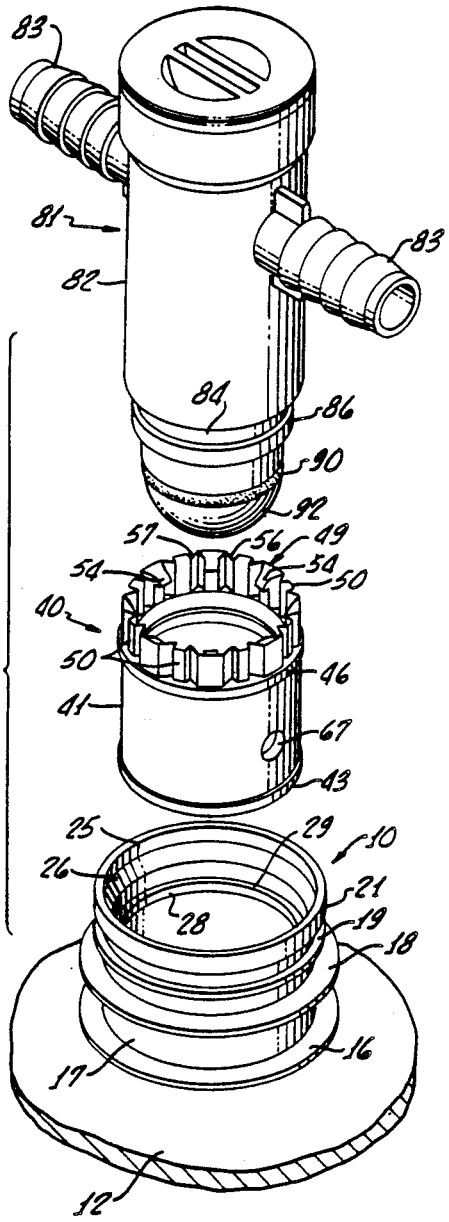
FIG. 1 is an exploded perspective view of the fluid dispensing arrangement of this invention.
Figure 2:
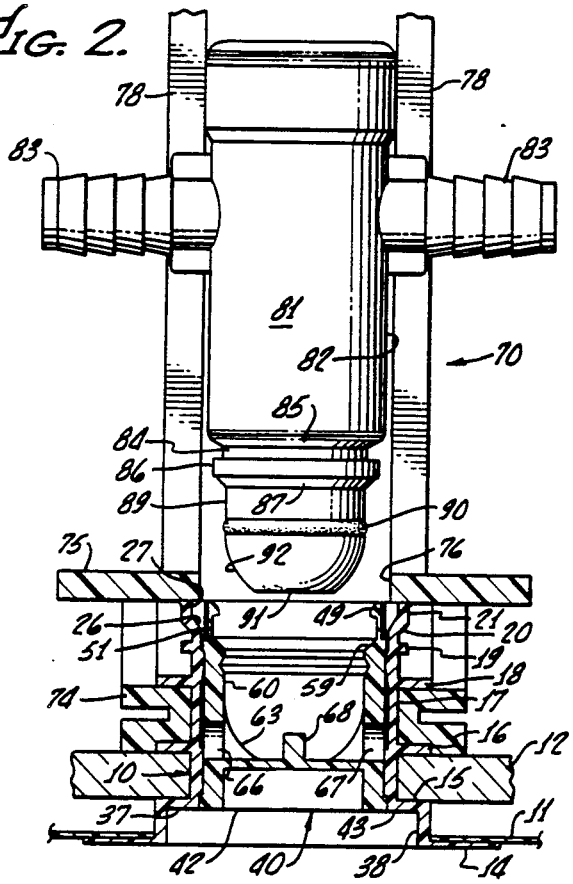
FIG. 2 is a longitudinal sectional view of the assembled dispensing arrangement with the probe separated from the valve member.
Figure 3:
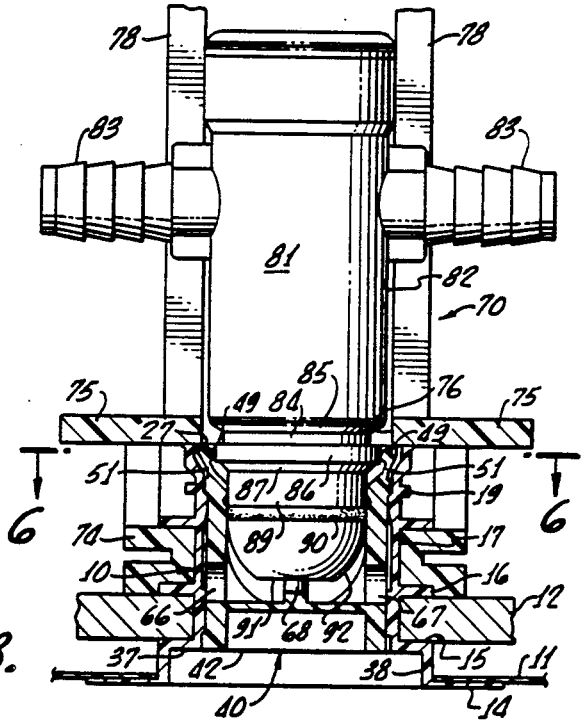
FIG. 3 is an enlarged view similar to FIG. 2 with the probe in an intermediate position deflecting portions of the valve member laterally outwardly.
Figure 5:
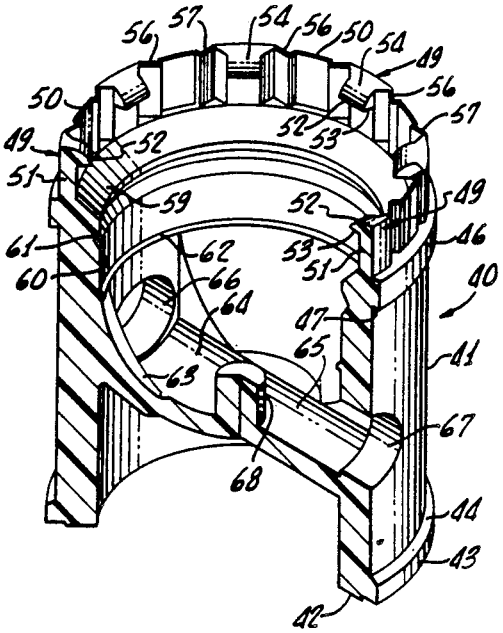
FIG. 5 is an enlarged fragmentary perspective view, partially in section, of the valve member removed from the spout.
Figure 7:
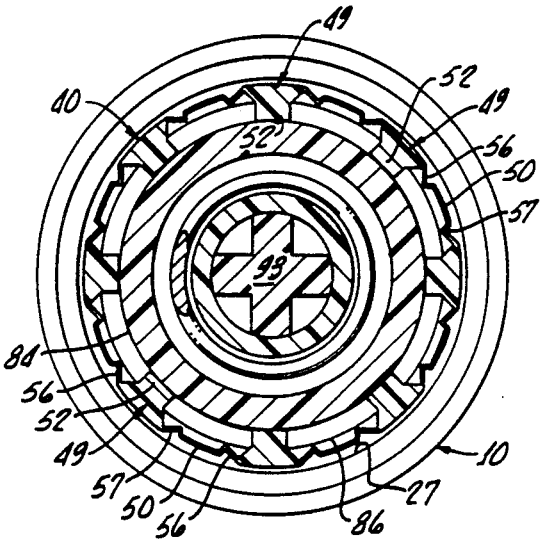
FIG. 7 is an enlarged transverse sectional view taken along line 7—7 of FIG. 12.

The dispenser of this invention, as seen in FIGS. 1–3, includes a tubular plastic spout 10 which, when in use, is attached to a flexible plastic bag 11 contained within a corrugated paper box 12. The bag and box are conventional for retaining a liquid to be dispensed, such as syrup for soft drinks. The spout 10, at its inner end, includes a relatively thin, outwardly projecting flange 14 that is bonded to the bag 11 to form a sealed connection. A short distance from the flange 14, the spout 10 is of reduced diameter. This provides a radial external shoulder 15. Spaced from the shoulder 15 is an external radial flange 16 projecting from the cylindrical outer cylindrical surface 17 of the spout. The flange 16 has the same outside dimension as that of the shoulder 15. The wall of the box 12 is received between the shoulder 15 and the flange 17. An additional exterior flange 18 is of the same diameter as the flange 16 and spaced from it. Beyond the flange 18 is another flange 19 of smaller diameter. The exterior of the spout includes an outwardly flaring portion 20 adjacent the flange 19, beyond which is a short cylindrical section 21 of increased diameter. A small rounded external annular bead 22 is provided at the outer end 23 of the spout 10.

Interiorly, the spout 10 includes a short cylindrical surface 25 extending inwardly from the outer end 23 and connecting to a beveled surface 26 that tapers toward the longitudinal axis of the spout. Inwardly of the surface 26 is a cylindrical surface 27, smaller in diameter than the surface 25. Spaced a short distance inwardly from the outer end of the cylindrical surface 27 is an annular ridge 28 that projects toward the longitudinal axis of the spout. A shoulder 29 that tapers toward the inner end of the spout connects the outer end of the ridge 28 to the cylindrical surface 27. An oppositely tapered surface 30, at a more shallow angle than the shoulder 29, joins the inner end of the ridge 28 and the surface 27.

Below the ridge 28 is a radial shoulder 32 that connects to a cylindrical surface 33 which is of smaller diameter than the surface 27. Two spaced annular beads 34 and 35 of rounded configuration project inwardly from the surface 33. Beneath the lower bead 35 is a radial shoulder 36 which connects to the inner portion of the cylindrical surface 27. A radial interior surface 37 connects the inner end of the cylindrical surface 27 to a short enlarged interior cylindrical surface 38 that extends to the inner end of the spout.

Figure 4:
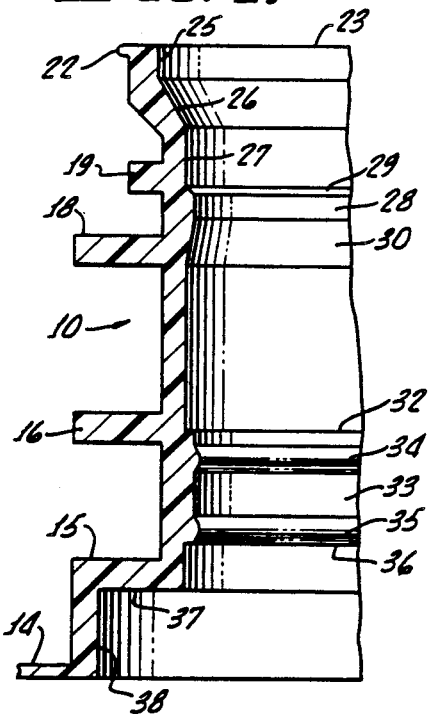
FIG. 4 is an enlarged fragmentary longitudinal sectional view of the spout.
Figure 6:
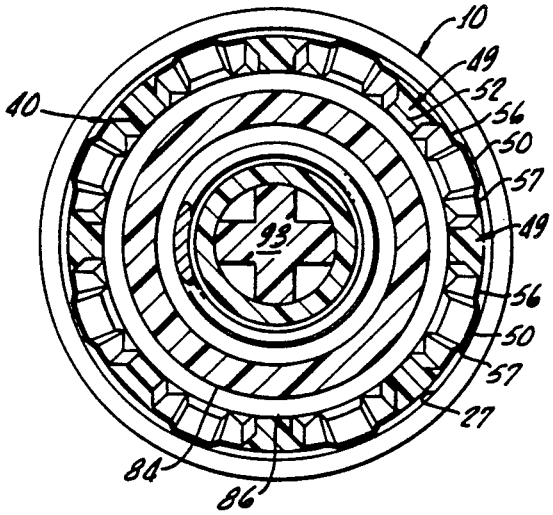
FIG. 6 is an enlarged transverse sectional view taken along line 6—6 of FIG. 3.

A valve member 40, of tubular configuration and also made of plastic, fits within the spout 10 in the assembled dispensing unit. The valve member 40, shown separately in FIG. 4, has a cylindrical exterior surface 41 extending for most of the length of the valve member. At the inner end 42 of the valve member is an exterior annular ridge 43 having a beveled surface 44 which connects to the surface 41 from which it slopes away toward the end 42.

Adjacent the outer end of the valve member is a second exterior annular ridge 46 that connects through a radial shoulder 47 at its inner end to the cylindrical surface 41.

The outer end of the valve member is defined by a plurality of thickened portions providing locking lugs 49, typically eight in number, interconnected by thin walled webs 50. Each of the locking lugs 49 includes a longitudinally extending post or support 51 at the outer end of which is carried a protrusion 52 extending radially inwardly. The surface 53 of the protrusion 52 on its underside is nearly in a radial plane, but tapers slightly toward the outer end of the valve member. The outer end surfaces 54 of the locking lugs 49 are rounded and incline axially inwardly to join the inner surfaces 53.

The thin webs 50 that interconnect the locking lugs 49 are provided with generally V-shaped segments 56 and 57 adjacent the locking lugs 49. In this manner the webs 50 provide undulant portions between the locking lugs and a continuous wall around the outer end of the valve member 40, but at the same time permit outward flexure of the locking lugs 49, as explained below.

Interiorly the valve member 40 includes a beveled surface 59 beneath the locking lugs 49 and webs 50 which is inclined axially inwardly. A cylindrical surface 60 connects to the inner edge of the beveled surface 59. Adjacent the latter is a V-shaped annular groove 61 Inwardly of the groove is a small annular bead 62. A dome-shaped end wall 63 is located inwardly of the bead 62 and is spaced from the inner end 42 of the valve member. Radial slots 64 and 65 lead to diametrically opposite cylindrical openings 66 and 67 through the cylindrical wall of the valve member. At the center of the dome-shaped wall 63 is a post 68 projecting at the longitudinal axis of the valve member a short distance toward the outer end.

The bead 62 and groove 61 of the valve member cooperate with a conventional cap (not shown) which is used to close off the end of the valve assembly as the unit is being shipped and prior to filling. The cap cooperates with the bead 62 and groove 61 to allow the valve member to be removed from the spout for the filling operation.

The valve member 40 is inserted into the outer end of the spout 10 and positioned as shown in FIGS. 2 and 8 after the bag 11 has been filled. When the valve member 40 is in the position of FIGS. 2 and 8, its outer end is at or close to the plane of the outer end 23 of the spout. In this position, the annular beads 34 and 35 of the spout bear tightly against the cylindrical wall 41 of the valve member beneath the openings 66 and 67 through the valve member. This provides a seal which prevents leakage of liquid from within the bag around the periphery of the valve member. There is no access to the openings 66 and 67 by liquid in the bag, and the valve is closed.

The valve member 40 is positively retained in the closed position of FIGS. 2 and 8 by shoulders of the valve member and spout. Thus, the inwardly facing shoulder 47 of the valve member is positioned adjacent the outwardly facing shoulder 29 of the spout which thereby resists inward axial movement of the valve member relative to the spout. In addition, the outwardly facing shoulder 44 at the lower end of the valve member 40 is opposite the inwardly facing shoulder 36 near the inner end of the spout. This retains the valve member against axial movement relative to the spout in the outward direction. Consequently, the duality of shoulders 44 and 47 of the valve member cooperate with the duality of shoulders 36 and 29, respectively, of the spout 80 that the valve member 40 is held against all but limited movement when it is in the closed position so that it will not inadvertently be pushed inwardly to an opened position, nor will it be accidentally withdrawn from the spout.

Fluid is dispensed from the bag 11 through a conventional service line connector, such as the connector 70 (shown in FIGS. 1, 2, 3 and 12), which is similar to the connector shown and described in U.S. Pat. No. 4,421,146. The connector assembly includes a guide 71 that attaches to the spout 10 and a probe unit 72 which is carried by the guide. The guide unit 71 includes a base portion having an arcuate C-shaped section 74 that extends for a little more than 180 degrees. This section fits over the outside wall 17 of the spout 10 between the flanges 16 and 18, attaching the guide unit 71 to the spout and bag assembly. The guide also includes a flat circular plate 75 which fits over the outer end 23 of the spout 10. Thus, the section 74 and flat plate 75 prevent axial movement of the guide 71 relative to the spout 10. The plate 75 includes an opening 76 through its central portion which allows the probe 71 to move through it.

Projecting outwardly from the plate 75 are four rails 78 which are in spaced parallelism.

The probe 72 includes a hollow body 81 that fits within the rails 78. The body 81 includes a principal portion 82 which is generally cylindrical and from which adjacent its outer end radially project two opposite fitments 83 adapted to be connected to hoses. At the inner end of the cylindrical portion 82 is an external annular groove 84 defined on one side by a beveled edge 85 and on the other side by an annular flange 86. The wall of the flange 86 is radial at the groove 84, but the other end of this flange includes a beveled surface 87 which tapers to a cylindrical surface 89. The latter surface is of smaller diameter than the longer cylindrical portion 82. An annular groove in the cylindrical surface 89 receives an O-ring 90. Connecting to the cylindrical surface 89 and extending to the inner end 91 of the body 81 is a surface 92 defined by a spherical segment.

Within the probe body 81 is a stem 93 connected to the body 81 by threads at its outer end portion 94 (FIG. 12). The inner end portion of the stem 93 extends within the tubular outer end portion 95 of a movable valve element 96. A compression spring 97 fits around the stem 93 and at one end engages a shoulder 98 on the stem and at the opposite end bears against a shoulder 99 on the valve member 96, biasing the valve member toward the end 91 of the body 81. This causes the outer end of the valve member 96 normally to be received in an opening 100 in the end of the probe body 81, with an O-ring 101 carried by the valve member bearing against the inner wall of the body 81 around the opening 100 to form a seal.

When the liquid in the bag 11 is to be dispensed, the probe 72 is advanced in the guide 71 toward the spout 10, causing the end portion of the probe to enter the valve member 40. As this occurs, the end surface 92 of the probe and the cylindrical surface 89 pass freely through the interior outer end of the valve member 40, being of lesser diameter than the valve member at the lugs 49 and beveled surface 59, and enter the portion bounded by the wall 60. The flange 86, however, being of larger diameter, engages the outer surfaces 54 of the locking lugs 49 as it enters the valve member 40. This deflects the locking lugs 49 outwardly away from their normal positions as the base portions 51 are bent outwardly. The V-shaped portions 56 and 57 of the thin webs 50 flex as this occurs, and permit the locking lugs 49 to be deflected outwardly. The rounded and inwardly inclined configuration of the outer ends of the locking lugs 49 and the beveled surface 87 help the flange 86 to slide smoothly over the locking lugs to deflect them outwardly in the radial direction. The clearance provided by the spout surfaces 25 and 26 permits this expansion of the end of the valve member. The valve member 40 does not move axially relative to the spout 10 at this time because of the opposed shoulders 29 and 47.

After the flange 86 has passed the locking lugs 49, the outer end portion of the valve member 40 is free to resume its normal shape, as the base portions 51 of the locking lugs 49 spring inwardly and the protuberances 52 enter the groove 84 of the probe, as seen in FIG. 10. The outer end portion of the valve member 40 then returns to its normal shape and overlies the periphery of the cylindrical portion 84 of the probe. As this movement of the probe relative to the valve occurs, the flange 86 of the probe comes into engagement with the surface 59 of the valve member 40, which terminates the movement of the probe relative to the valve.

As this position is reached, the outer end of the valve element 96 of the probe is brought into engagement with the outer end of the post 68 of the valve member 40, which presses the probe valve element 96 inwardly relative to the body 82 in opposition to the spring 97. This opens communication from the interior of the valve member 40 to the interior of the probe body 82 and to the outlet fitments 83. However, no fluid flow occurs because the beads 34 and 35 continue to seal against the outer wall 41 of the valve member 40.

Further advancement of the probe 72 causes the valve member 40 to move with it, because of the engagement of the flange 86 with the valve surface 59. This causes the ridge 46 of the valve member to deflect the ridge 28 of the spout 10 laterally as the spout wall is stretched and the ridge 46 is forced past the ridge 28. The valve member 40 then may be moved axially inwardly of the spout to the open position of FIGS. 11 and 12. When this occurs, the openings 66 and 67 become located beyond the sealing beads 34 and 35 and are at the enlarged spout wall 38 and in communication with the interior of the bag 11. Consequently, the liquid may be dispensed from the bag 11 through the openings 66 and 67 to the interior of the valve member, and thence through the probe to the outlet fitments 83. The O-ring 90 provides a seal between the outside of the probe and the inner wall 60 of the valve member so that the liquid cannot flow around the exterior of the probe.

The exterior surface of the valve member continues to be sealed relative to the spout by the beads 34 and 35 of the spout bearing against the outer circumferential surface 41 of the valve member. Hence, liquid cannot flow between the valve member and the spout.

The valve may be closed by pulling outwardly on the probe 72 to return the valve member 40 to a position in which the openings 66 and 67 are within the spout surface 27 past the sealing beads 34 and 35. The valve member 40 moves with the probe in the outward direction because of the engagement of the flange 86 with the protuberances 52 of the locking lugs 49. The protuberances 52 remain in the groove 84 because the locking lugs 49 and interconnecting webs 50 resist outward displacement. Therefore, the valve may be closed, as desired, simply by pulling outwardly on the probe.

The probe may be removed from the valve altogether by further outward movement in which the flange 86 deflects the outer end portion of the valve member radially to remove the protuberances 52 from the groove 84. This is possible because outward movement of the valve member is arrested as the shoulder 44 of the ridge 43 of the valve member is brought into engagement with the shoulder 36 of the spout. This enables the probe flange 86 to force the protuberances 52 out of the groove 84 as the outer end of the valve member is stretched. This expansion of the outer end of the valve member 40 can take place because it is then at the spout surfaces 25 and 26, which are of increased diameter.

The foregoing detailed description is to be clearly understood as given by way of illustration and example only, the spirit and scope of this invention being limited solely by the appended claims.

What is claimed is:

1. A fluid dispensing device adapted to be connected to a fluid-transmitting probe having a recess therein comprising a tubular spout adapted for connection to a vessel containing fluid, said spout including a first outer section of a first interior lateral dimension and a second section inwardly of said first section of a second and smaller interior lateral dimension, and a valve member in said spout and slidable therein between a first outer position and a second inner position, said valve member being hollow, having an open outer end for receiving a fluid-transmitting probe, having a closed inner end, and having opening means through the side portion thereof for providing communication between the exterior and interior of said valve member, said opening means being within said second section of said spout when said valve member is in said first position, said valve member and said spout including surfaces interengaged and positioned to seal said opening means when said valve member is in said first position for preventing fluid flow from inner end of said spout into said valve member, said surfaces not being so positioned when said valve member is in said second position so that said opening is not so sealed for allowing fluid to flow from the inner end of said spout into said valve member, said valve member having a portion which includes laterally inwardly projecting means thereon, and resilient means carrying said laterally inwardly projecting means in a normal laterally inward position, said resilient means being outwardly bendable, said portion of said valve member being in said first section of said spout when said valve member is in said first position thereof and being of smaller exterior lateral dimension than that of said first section of said spout such that said portion of said valve member is spaced from the surface of said first section of said spout for permitting lateral outward bending of said resilient means to enable said laterally inwardly projecting means to be deflected outwardly by a probe entering said valve member, and to enable said resilient means to return said laterally inwardly projecting means to said normal position so that said laterally inwardly projecting means can enter a recess in such a probe, so that the probe can move said valve member from said first position to said second position, and can return said valve member from said second position to said first position, said portion of said valve member being in said second section of said spout when said valve member is in said second position thereof.

2. A device as recited in claim 1 in which said valve member and said spout include abutment means for releasably retaining said valve member against movement from said first position to said second position thereof.

3. A device as recited in claim 2 in which said abutment means include an outwardly facing shoulder adjacent the outer end of said spout and an inwardly facing shoulder adjacent the inner end of said spout, and a duality of shoulders on said valve member opposite from said shoulders on said spout and providing interchangeable interfering surfaces for resisting substantial movement of said member in either direction axially of said spout.

4. In combination with a fluid-transmitting probe having an exterior recess means and a laterally outwardly projecting means adjacent said recess means, a fluid dispensing device comprising a tubular spout having an outer end and an inner end, attachment means at said inner end adapted for attachment to a fluid-containing vessel, and a duality of shoulders on the inner surface thereof, the first of said shoulders being adjacent and facing said outer end, and the second of said shoulders being spaced from said first shoulder, and adjacent and facing said inner end, said spout having a first section adjacent said outer end and a second section inwardly of said outer end, said second section having a smaller lateral dimension than that of said first section, a valve member in said spout, said valve member being a hollow tubular member with an open outer end adapted to receive said probe and a closed inner end, said valve member having a duality of spaced shoulders on the exterior surface thereof, the first of said shoulders of said valve member being adjacent said outer end thereof, and facing said inner end thereof and the second of said shoulders of said valve member being adjacent said inner end thereof and facing said outer end thereof, opening means extending through the wall of said valve member, laterally inward protrusion means adjacent the outer end of said valve member, and resilient means carrying said laterally inward protrusion means in a normal inward position, said resilient means being laterally outwardly bendable so that said laterally inward protrusion means are laterally outwardly deflectable, said valve member at said protrusion means being of a smaller exterior lateral dimension than that of said first section of said spout, said valve member and said spout having interengaged sealing means for preventing liquid flow between the exterior of said valve member and the interior of said spout, said valve member being movable relative to said spout between a first position and a second position, said valve member and said spout being arranged such that when said valve member is in said first position, said first shoulder of said spout is adjacent and opposite from said first shoulder of said valve member, said second shoulder of said spout is adjacent and opposite from said second shoulder of said valve member for thereby providing a resistance to substantial axial movement of said valve member in either direction, said sealing means prevents liquid flow from the interior of said spout to said opening means, and said protrusion means is adjacent said first section of said spout for permitting outward deflection of said protrusion means, said laterally outwardly projecting means of said probe being dimensioned so as to engage said protrusion means for deflecting said protrusion means outwardly when said probe enters said valve member, whereby said resilient means causes said protrusion means subsequently to move laterally inwardly to enter said recess means, whereby said valve member is being movable by said probe to said second position in which said opening means are inwardly of said sealing means for permitting fluid to flow from a vessel attached to said spout through said opening means into said probe, and said valve member is movable by said probe from said second position to said first position for preventing such flow.

5. A device as recited in claim 4 in which for said sealing means said spout includes at least one inwardly projecting annular bead in said second section thereof engaging the outer surface of said valve member.

6. A device as recited in claim 4 in which said valve member at said outer end includes a continuous annular wall, said laterally inward protrusion means extending laterally inward from said continuous annular wall.

7. A device as recited in claim 6 in which said laterally inward protrusion means comprises a plurality of segments spaced from each other around the inner periphery of said valve member.

8. A device as recited in claim 7 in which said continuous annular wall is thinner intermediate said laterally inward protrusion means than it is at said laterally inward protrusion means.

9. A device as recited in claim 8 in which said continuous annular wall intermediate said laterally inward protrusion means includes undulant portions for facilitating outward deflection of said laterally inward protrusion means.

10. A device as recited in claim 8 in which for said resilient means said continuous annular wall provides relatively thick portions thereof axially inward of said laterally inward protrusion means for providing laterally outwardly bendable resilient posts supporting said laterally inward protrusion means, said posts being so bent outwardly when said laterally outwardly projecting means of said probe so deflects said protrusion means outwardly, said posts resiliently returning to their original positions thereafter for causing said protrusion means to so enter said recess means of said probe.

11. A device as recited in claim 10 in which said continuous annular wall incudes a generally V-shaped portion on either side of each of said posts for facilitating outward bending of said posts.

12. A device as recited in claim 4 in which said second shoulder of said spout and said second shoulder of said valve member resist outward movement of said valve member relative to said spout such that said probe can be removed from said valve member by deflecting said protrusion means laterally out of said recess means.

13. In combination with a fluid-transmitting probe having an exterior recess means and a laterally outwardly projecting means adjacent said recess means, a fluid dispensing device comprising a tubular spout having an outer end and an inner end, attachment means at said inner end adapted for attachment to a fluid-containing vessel, and a duality of shoulders on the inner surface thereof, the first of said shoulders being adjacent and facing said outer end, and the second of said shoulders being spaced from said first shoulder and adjacent and facing said inner end, said spout having a first section adjacent said outer end and a second section inwardly of said outer end, said second section having a smaller lateral dimension than that of said first section, a valve member in said spout, said valve member being a hollow tubular member with an open outer end adapted to receive said probe and a closed inner end, said valve member having a duality of spaced shoulders on the exterior surface thereof, the first of said shoulders of said valve member facing said inner end thereof, and the second of said shoulders of said valve member facing said outer end thereof, opening means extending through the wall of said valve member, and laterally inward protrusion means adjacent the outer end of said valve member, said laterally inward protrusion means being resiliently laterally outwardly deflectable, said valve member at said protrusion means being of a smaller exterior lateral dimension than that of said first section of said spout, said valve member being movable relative to said spout between a first position and a second position, sealing means for providing a seal between said valve member and said spout for preventing flow of fluid from a fluid-containing vessel attached to said means at said inner end of said spout to said opening means of said valve member when said valve member is in said first position thereof, said valve member and said spout being arranged such that when said valve member is in said first position, said first shoulder of said spout is adjacent and faces said first shoulder of said valve member, said second shoulder of said spout is adjacent and faces said second shoulder of said valve member for thereby providing a resistance to substantial axial movement of said valve member in either direction, and said protrusion means is adjacent said first section of said spout for permitting outward deflection of said protrusion means, said laterally outwardly projecting means of said probe being dimensioned so as to engage said protrusion means for deflecting said protrusion means outwardly when said probe enters said valve member for permitting said protrusion means subsequently to move laterally inwardly to enter said recess means, said valve member being movable by said probe to said second position, said valve member and said spout being arranged such that where said valve member is in said second position, said opening means is remote from said sealing means for permitting fluid to flow from a fluid-containing vessel attached to said means at said inner end of said spout through said valve means into said probe, said protrusion means cooperating with said recess means to permit said probe to move said valve member back to said first position of said valve member.

* * * * *